US005903200A

United States Patent [19]

Ogawa et al.

[11] Patent Number: 5,903,200

[45] Date of Patent: May 11, 1999

[54] STRUCTURE OF ELECTROMAGNETIC RELAY

[75] Inventors: Takanori Ogawa; Masao Fukuda, both of Tokyo, Japan

[73] Assignee: Niles Parts Co., Ltd., Japan

[21] Appl. No.: 08/787,103

[22] Filed: Jan. 22, 1997

[30] Foreign Application Priority Data

Jan. 29, 1996 [JP] Japan ..... 8-034338

[51] Int. Cl.[6] ..... H01H 51/22

[52] U.S. Cl. ..... 335/78; 257/415

[58] Field of Search ..... 335/78–86, 124, 335/128; 257/415; 439/68–73, 525–6

[56] References Cited

U.S. PATENT DOCUMENTS 5,587,693 12/1996 Fear ..... 335/128

5,606,298 2/1997 Weiser ..... 335/78

*Primary Examiner*—Lincoln Donovan

*Attorney, Agent, or Firm*—Ronald P. Kananen

[57] ABSTRACT

An electromagnetic relay in which an iron core 2 is fixed to a yoke 3, and one end of the yoke 3 is fixed by press-fitting to a base 4. The base 4 is formed with a yoke-receiving groove 4*b* into which tongue pieces 3*e*, 3*e* at one end of the yoke 3 are press-fitted, and a cutout groove 4*c* into which a head portion 2*c* of the iron core 2 is received. The yoke 3 is formed with a seal projection 3*f* disposed by insertion in an opening end of a cutout groove 4*c* of the base 4. This construction of the electromagnetic relay eliminates poor operation by preventing metal chips produced during assembly from adhering to electrical contacts of the relay.

7 Claims, 5 Drawing Sheets

STRUCTURE OF ELECTROMAGNETIC RELAY

BACKGROUND OF THE INVENTION

1. Field of the Invention

The present invention relates generally to electromagnetic relays and, more particularly, to a structure of an electromagnetic relay which has a base formed with a cutout groove into which a head portion of an iron core is fitted, and a yoke formed with a seal projection closing an opening end of the cutout groove of the base.

2. Description of the Prior Art

A conventional electromagnetic relay structure is disclosed, for example, in Japanese Unexamined Utility Model Publication No. H2-104547. This conventional electromagnetic relay has a split groove in a yoke into which a small diameter portion of an iron core is press-fitted, thereby fixing the iron core. The yoke is fixed by press-fitting its end portion to the base.

In the conventional electromagnetic relay described above, however, the iron core is fixed by press-fitting to the yoke, so that metal chips are produced when the iron core is press-fitted to the yoke. These metal chips tend to adhere to contact portions or actuating portions of the electromagnetic relay, causing problems due to the occurrence of poor contacting.

SUMMARY OF THE INVENTION

It is therefore an object of the present invention to provide an electromagnetic relay structure that solves the problems associated with the conventional electromagnetic relay described above.

More specifically, it is an object of the present invention to confine the metal chips to a gap inside the electromagnetic relay defined by an inner wall of a cutout groove and a seal projection, by forming a base with a yoke-receiving groove into which a tongue piece at one end of a yoke is press-fitted and a cutout groove into which a head portion of the iron core is received, and forming a yoke with a seal projection insert-disposed into an opening end of the cutout groove of the base.

Additional objects, advantages and novel features of the invention will be set forth in part in the description that follows, and in part will become apparent to those skilled in the art upon examination of the following or may be learned by practice of the invention. The objects and advantages of the invention may be realized and attained by means of the instrumentalities and combinations particularly pointed out in the appended claims.

In accordance with the present invention, in order to solve the problems described above, an electromagnetic relay is provided wherein an iron core is fixed to a yoke and one end of the yoke is fixed by press-fitting to a base. The electromagnetic relay is characterized by the base being formed with a yoke-receiving groove into which tongue pieces at one end of the yoke are press-fitted and a cutout groove into which a head portion of the iron core is received, and the yoke being formed with a seal projection disposed by insertion into an opening end of a cutout groove of the base.

Further, according to a second aspect of the invention, the base of the electromagnetic relay is formed, adjacent to the yoke-receiving groove, with fitting grooves into which projecting rods formed in a flanged portion of a bobbin are press-fitted.

Still further, according to a third aspect of the invention, the base of the electromagnetic relay has a projecting rib formed with the yoke-receiving groove, the cutout groove, and the fitting grooves.

Finally, according to a fourth aspect of the invention, the iron core is formed with a small diameter portion for being fitted into a U-shaped split groove of the yoke, and a head portion for being fitted into a cutout groove of a base.

BRIEF DESCRIPTION OF THE DRAWINGS

The present invention will become more clearly appreciated as the disclosure of the invention is made with reference to the accompanying drawings. In the drawings.

DETAILED DESCRIPTION OF THE INVENTION

A preferred embodiment of an electromagnetic relay structure according to the present invention will be described with reference to FIGS. 1 to 5 of the accompanying drawings.

Figure 3:
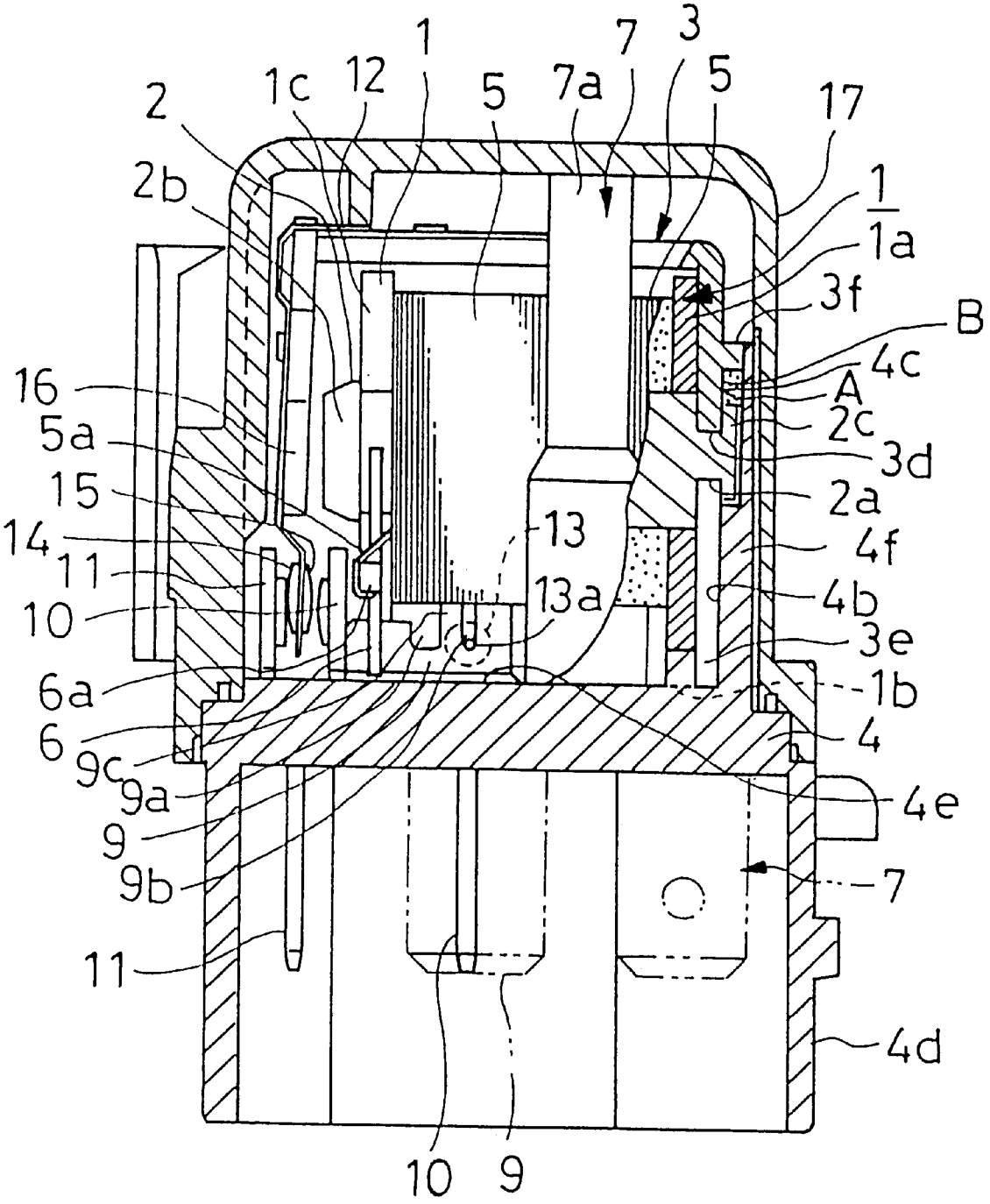
FIG. 3 is an enlarged cross-sectional front view of the base of the electromagnetic relay structure according to the present invention.

The electromagnetic relay includes a bobbin 1, an iron core 2, and a yoke 3. A coil 5 is wound around the bobbin 1, as shown in FIG. 3, and the iron core 2 is inserted through the bobbin 1. The bobbin 1 has one flanged portion 1*a* on a side of the bobbin 1 fixed to the yoke 3. The flanged portion 1*a* includes projecting rods 1*b*, 1*b* formed at lower opposite ends thereof. The bobbin 1 has a second flanged portion 1*c* on a side of the bobbin 1 toward an armature 16. The flanged portion 1*c* has lower opposite ends formed with insertion holes 1*d*, 1*d* into which respective upper ends 6*c*, 6*c* of a pair of coil terminals 6, 6 are press-fitted. The bobbin 1 is fixed on a base 4 by press-fitting the projecting rods 1*b*, 1*b* into respective fitting grooves 4*a*, 4*a* and by press-fitting the fitted coil terminals 6, 6 onto respective upper ends of terminals 8, 9. Further, the bobbin 1 is supported on the iron core 2 by fixing the iron core 2 into a U-shaped split groove 3*a* of the yoke 3.

The iron core 2, which is inserted into a center of the bobbin 1, is formed with head portions 2*b*, 2*c* at respective ends thereof. A small diameter portion 2*a* is provided adjacent the head portion 2*c* on the side of the yoke 3. The iron core 2 at its small diameter portion 2*a* is press-fitted into the U-shaped split groove 3*a* provided in the yoke 3, thereby securing the iron core 2 and the bobbin 1 to the yoke 3. The iron core 2 is formed with the head portion 2*c* at its end by the formation of the small diameter portion 2*a* to be press-fitted into the U-shaped split groove 3*a*. The head portion 2*c* is received in the U-shaped cutout groove 4*c* by attaching the bobbin 1 inserted with the iron core 2 onto the base 4.

Figure 1:
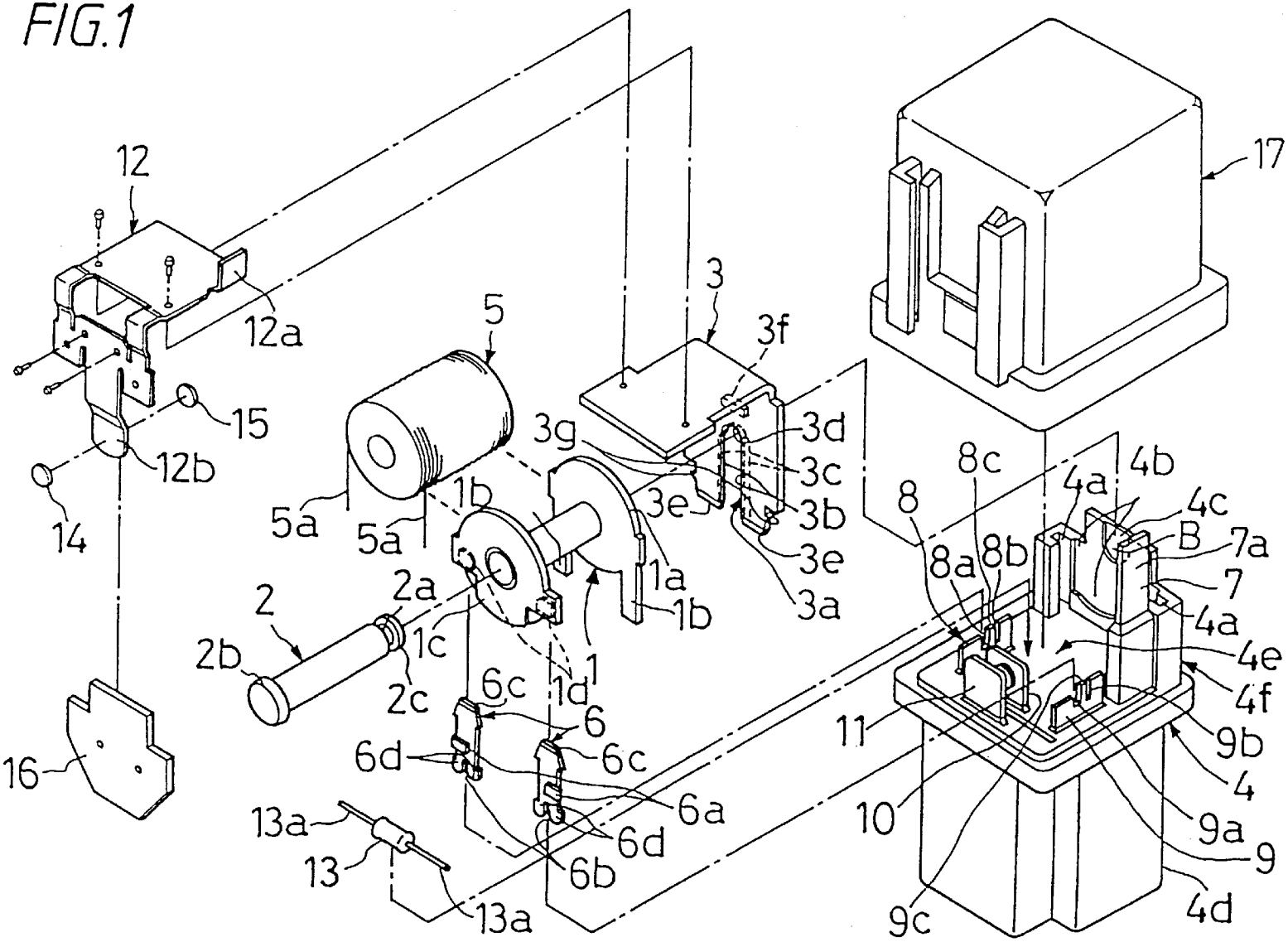
FIG. 1 is an exploded perspective view of a structure of an electromagnetic relay showing a preferred embodiment of the present invention.
Figure 4:
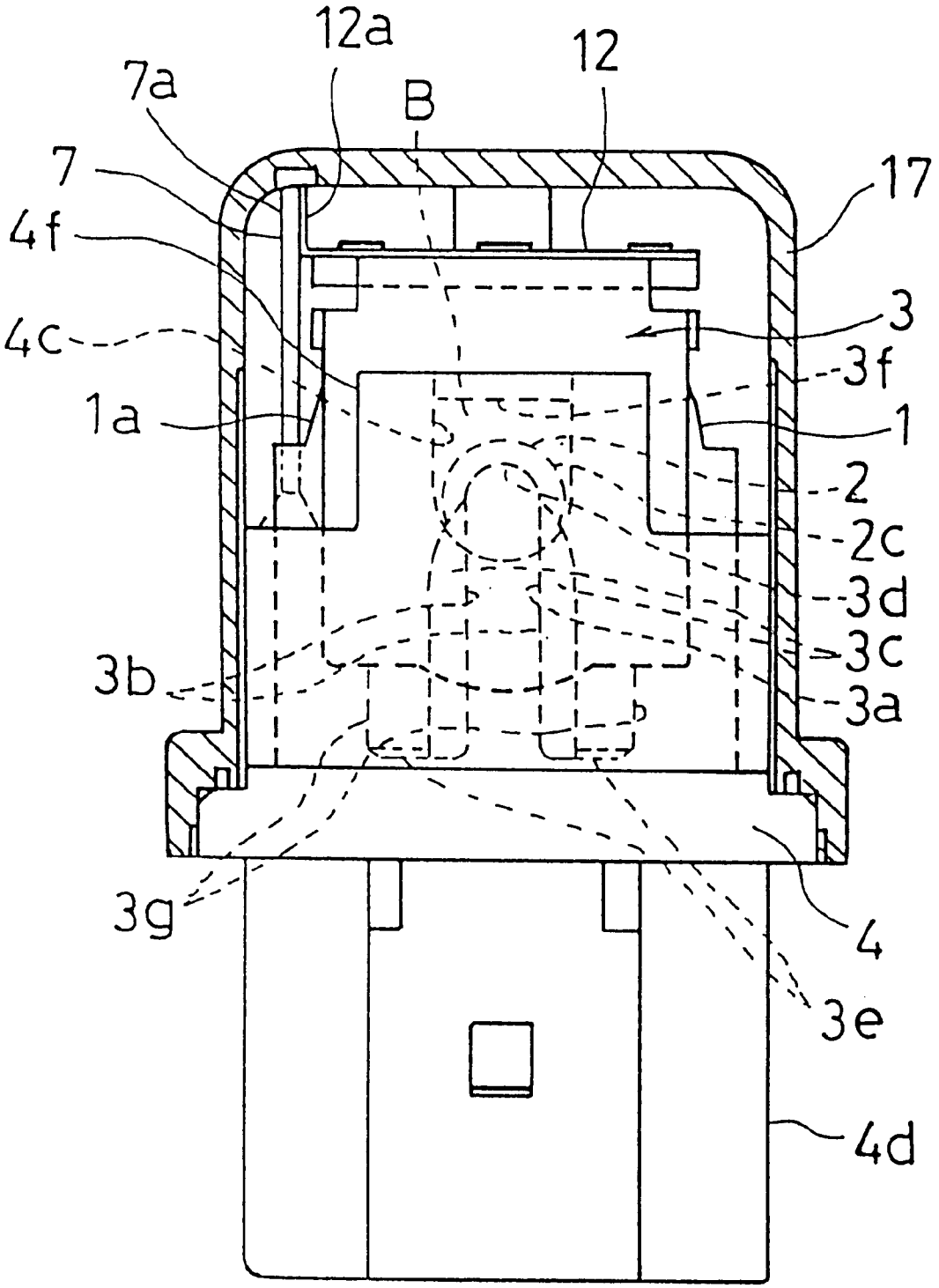
FIG. 4 is an enlarged cross-sectional side view of the base of the electromagnetic relay structure according to the present invention.
Figure 5:
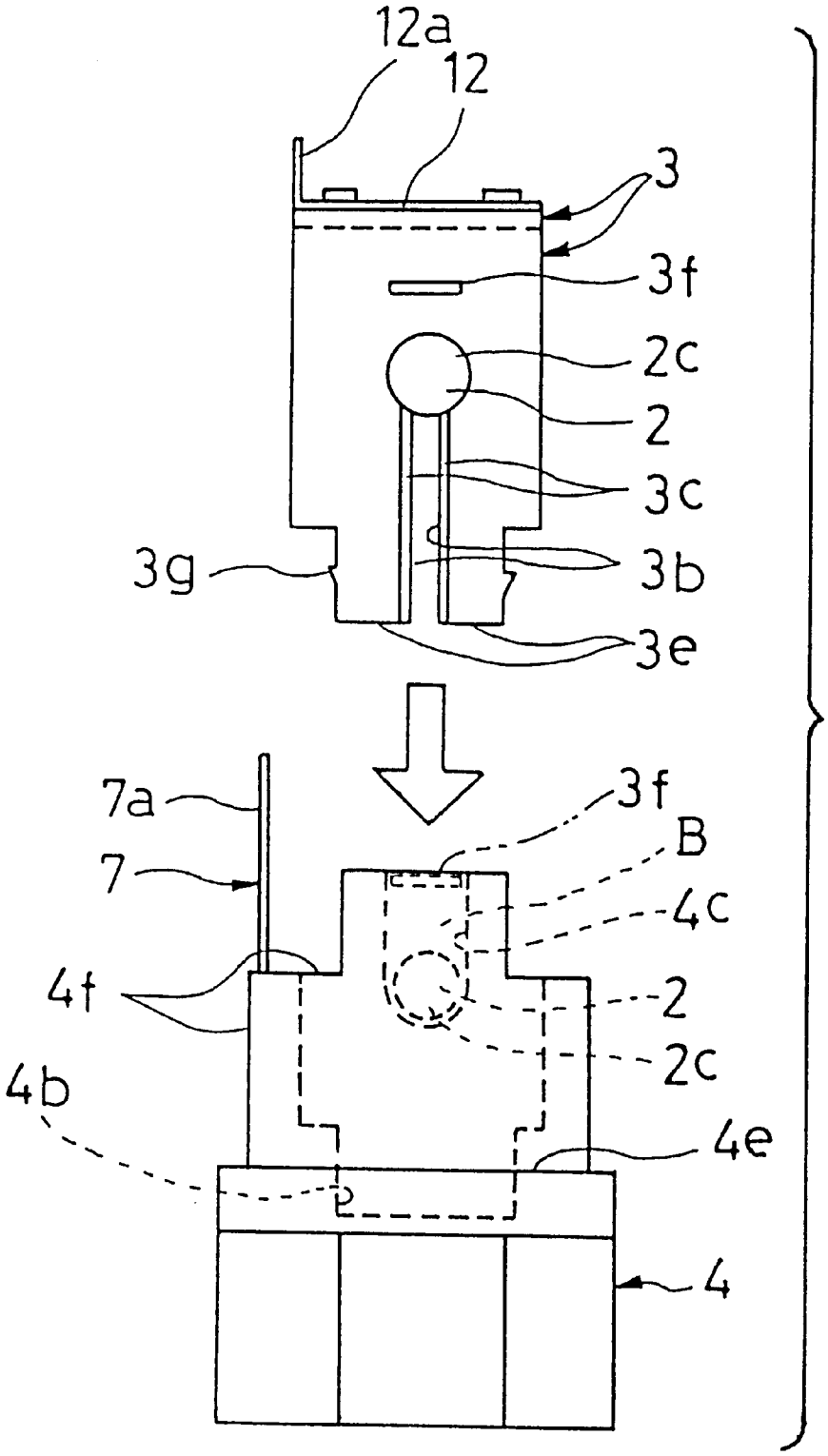
FIG. 5 is an explanatory side view of a yoke being assembled to the base of the electromagnetic relay structure, wherein a seal projection is received in a cutout groove.

The yoke 3 is formed by a conductive plate member in generally an L form. The yoke 3 has tongue pieces 3*e*, 3*e* formed at one end, and a leaf spring 12 of an electrically conductive member fixed at the other end by tightening screws. The U-shaped split groove 3*a*, as shown in FIGS. 1, 4, and 5, is cutout-formed into a U-shape, and formed with slant surfaces 3*c* in the outer opposite ends 3*b* thereof. The U-shaped split groove 3*a* has a deep end 3*d* formed in a semicircular shape. The slant surfaces 3*c* are formed in an arcuate form on the side of the deep end 3*d*, as shown in FIGS. 1, 4, and 5.

The yoke 3 is formed with two tongue pieces 3*e*, 3*e* by the cutout-formation of the U-shaped split groove 3*a*. The yoke 3 is formed with a seal projection 3*f* in an outer lateral surface thereof above the U-shaped split groove 3*a* for being fitted into an upper opening end of the cutout groove 4*c*. The tongue pieces 3*e*, 3*e* are formed in a sawtooth form in their outer lower ends and are press-fitted into a yoke-receiving groove 4*b* of the base 4. With the yoke 3, if the tongue pieces 3*e*, 3*e* are press-fitted into the yoke-receiving groove 4*b*, the seal projection 3*f* is received in an opening end of the U-shaped cutout groove 4*c*. Engaging claws 3*g*, as shown in FIGS. 1, 4, and 5, are formed in outer surfaces of the tongue pieces 3*e*, 3*e*, which cut into inner walls of the yoke-receiving grooves 4*b* to firmly fix the yoke 3 on the base when the yoke 3 is press-fitted to the base 4.

The base 4 is insert-formed with terminals 7, 8, 9, 10, 11. The base 4 is integrally formed with a rib 4*f* for preventing curving and vibration of a vibration preventive portion 7*a* projecting from a panel face 4*e*. The rib 4*f* is formed by a wall projection in a generally squared U-shape projecting from the panel face 4*e*, and has the fitting groove 4*a*, 4*a*, the yoke-receiving groove 4*b*, and the cutout groove 4*c* formed in an inner wall face thereof.

The respective ends 5*a*, 5*a* of the coil 5 wound around the bobbin 1 are twined around the projecting pieces 6*a*, 6*a* on the coil terminals 6, 6 for providing electrical connection.

Figure 2:
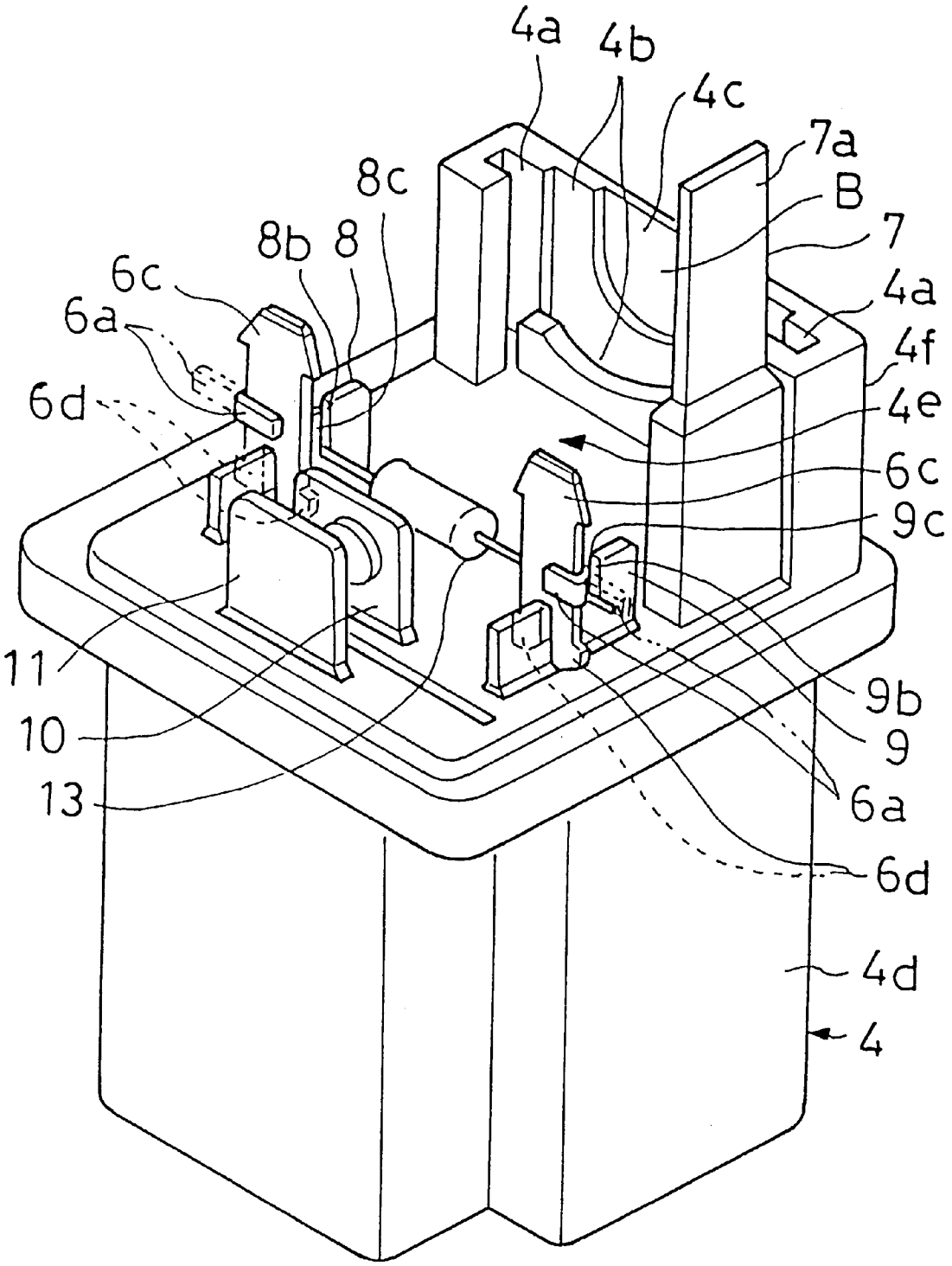
FIG. 2 is an enlarged perspective view of a base of the electromagnetic relay according to the present invention.

The coil terminals 6, 6, as shown in FIGS. 1 and 2, have upper ends 6*c*, 6*c* firmly fixed in the insertion holes 1*d*, 1*d*, lower ends press-fitted on an upper end of the terminals 8, 9, and intermediate portions having projecting pieces 6*a*, 6*a* formed projecting therefrom. The projecting pieces 6*a*, 6*a* have respective ends 5*a*, 5*a* of the coil 5 wound therearound. The projecting pieces 6*a*, 6*a* are then bent 180° with the ends 5*a*, 5*a* wound therearound.

Forked portions 6*b*, 6*b* each comprise a groove formed between semicircular projections 6*d*, 6*d*, which are to be press-fitted onto upper ends of the terminal 8, 9. The width of the forked portion 6*b*, 6*b* is the same as or somewhat narrower than the thickness of the terminal 8, 9 so that the terminal 8, 9 can receive the forked portion 6*b*. The upper end 6*c*, 6*c* is generally in a wedge form fixed by press-fitting into the insertion holes 1*d*, 1*d*.

The terminals 7, 8, 9, 10, 11 project at their upper ends from the panel face 4*e* with the other ends projected toward the inside of a connector 4*d*. The terminal 7 is integrally formed with the vibration preventive portion 7*a* projecting from the base 4.

The vibration preventive portion 7*a* serves dual purposes as an electricity conductive passage electrically connecting between the leaf spring 12 firmly fixed at one end to the yoke 3 and the terminal 7 firmly fixed to the base 4, and as a member for sustaining the yoke 3. The terminal 7 is spot-welded to a connecting piece 12*a* of the leaf spring 12 whose upper end is firmly attached to the yoke 3.

The terminals 8, 9 each have a split groove 8*a*, 9*a*, a split groove 8*b*, 9*b* into which a lead wire 13*a*, 13*a* is press-fitted, and a sustaining piece 8*c*, 9*c* provided by the formation of the split groove 8*a*, 9*a* and the split groove 8*b*, 9*b*. These terminals 8, 9 are arranged such that they deviate 90 degrees with respect to the coil terminals 6, 6.

The terminal 10 and the terminal 11 project from the panel face 4*e* and are juxtaposed in an opposed relation. Between the terminal 10 and the terminal 11 are interposed movable contacts 14, 15 which are firmly attached to an actuating piece 12*b* of the leaf spring 12. The leaf spring 12, which is formed by a conductive sheet member, is fixed by screw fastening onto the yoke 3 and is screw-fastened with the armature 16.

The electronic element 13 is a resistor or the like having lead wires 13*a*, 13*a* extending in right and left directions. The movable contacts 14, 15 are formed by drum-shaped contact members, which are deposited or fastened to the leaf spring 12. The armature 16 is formed by an electrically conductive metallic sheet material, which is screw-fastened to the leaf spring 12. A case 17, as shown in FIGS. 1, 3, and 4, is fitted on the base 4 and secured by ultrasonic welding or the like to provide an enclosure. The case 17 is formed of a resin or the like.

The operation of the electromagnetic relay according to the present invention will now be described together with the assembling procedure.

First, the terminals 7, 8, 9, 10, and 11 are insert-formed to the base 4. The terminal 7 is integrally-formed with the vibration preventive portion 7*a*, thereby reducing the number of parts and the process steps for assembling. The opposite lead wires 13*a*, 13*a* of the electronic element 13 are press-fitted into the respective split grooves 8*b*, 9*b* of the terminals 8, 9, and are held by bending the sustaining pieces 8*c*, 9*c* toward the electronic element 13. The coil 5 is wound around the bobbin 1. The coil terminals 6, 6 are press-fitted at their upper ends 6*c*, 6*c* into the respective insertion holes 1*d*, 1*d* so that the coil terminals 6, 6 are firmly attached on the bobbin 1.

The ends 5*a*, 5*a* of the coil 5 are wound around the projecting pieces 6*a*, 6*a*, and the projecting pieces 6*a*, 6*a* are bent with the ends 5*a*, 5*a* of the coil 5 wound therearound. This allows the ends 5*a*, 5*a* of the coil 5 to be sustained by the bent projecting pieces 6*a*, 6*a*, thereby preventing untying and falling of the ends 5*a*, 5*a* from the coil terminals 6, 6. Also, the coil 5 has at its ends 5*a*, 5*a* connecting portions which are easily fixable without soldering.

The projecting rods 1*b*, 1*b* are press-fitted into the first fitting grooves 4*a*, 4*a* of the base 4, and the protuberances 6*d*, 6*d* of the coil terminals 6, 6 are press-fitted onto the upper ends of the terminals 8, 9, thereby firmly fixing the bobbin 1 on the base 4 at opposite sides. The bobbin 1 can be firmly fixed to the base 4 in a manner free from being jolted by press-fitting the one flange 1*a* with the projecting rods 1*b*, 1*b* thereof into the first fitting grooves 4*a*, 4*a* and by press-fitting the other flange 1*c* with the coil terminals 6, 6 firmly fixed thereon onto the terminals 8, 9. Also, two sets of the coil terminals 6, 6 attached to the bobbin 1 can be completely prevented from jolting sideways by engaging and press-fitting between the forked portions 6*b*, 6*b* and the two sets of the terminals 8, 9.

The movable contacts 14, 15 are fused onto the leaf spring 12, and the yoke 3 and the armature 16 are screw-fastened to the leaf spring 12. The iron core 2 is inserted into a through-hole of the bobbin 1. The tongue pieces 3*e*, 3*e* of the yoke 3 are respectively press-fitted into the second fitting grooves 4*b*, while the small diameter portion 2*a* of the iron core 2 is press-fitted into the deep end 3*d* of the U-shaped split groove 3*a*, thereby attaching the iron core 2 and the yoke 3 to the base 4. This allows the iron core 2 to be press-fitted into the U-shaped split groove 3*a* of the yoke 3, thereby firmly securing the bobbin 1 to the base 4.

When the yoke 3 is fixed by press-fitting onto the base 4, the iron core 2 is secured at its smaller diameter portion 2*a* by an inner wall of the U-shaped split groove 3*a*, thereby producing metal chips A (FIG. 3). The metal chips A are confined within a void B defined by the cutout groove 4*c* of the base 4, the flanged portion 1*a* of the bobbin 1, the head portion 2*c* of the iron core 2, the seal projection 3*f*, and the tongue pieces 3*e*, 3*e* of the yoke 3. This prevents the metal chips A from being dispersed in the case 17, and reduces the possibility of incurring poor operation due to adhesion of the metal chips A to the leaf spring 12, the armature 16, the movable contacts 14, 15, the fixed contacts of the terminals 10, 11, and so forth.

The connecting piece 12*a* is spot-welded to the vibration preventive portion 7*a*. The leaf spring 12 is fixed on the yoke 3 using screws, with the connecting piece 12*a* thereof spot-welded to the vibration preventive portion 7*a*, thereby providing electrical connection between the terminal 7 and the movable contacts 14, 15 and firmly fixing the leaf spring 12 and the yoke 3. The vibration preventive portion 7*a* of the terminal 7 is supported by a rib 4*f*, which has a generally squared U-form shape, projecting from the panel face 4*e*, thereby providing excellent impact resistance and vibration resistance without incurring curvature.

The electromagnetic relay structure according to the present invention, as described above, provides the following effects.

(1) A first aspect of the present invention is characterized by an electromagnetic relay wherein an iron core is fixed to a yoke and one end of the yoke is fixed by press-fitting to a base, the base being formed with a yoke-receiving groove into which tongue pieces at one end of the yoke are press-fitted and a cutout groove into which a head portion of the iron core is received, and the yoke being formed with a seal projection disposed by insertion into an opening end of a cutout groove of the base. This structure prevents metal chips produced upon press-fitting the yoke to the base from being dispersed inside the case and adhered to the leaf spring and the armature as actuating portions for the electromagnetic relay as well as the movable contacts and the fixed contacts as contact portions, thereby preventing poor operation due to metal chips on the electrical contacts.

(2) A second aspect of the present invention is characterized by the base being formed, adjacent to the yoke-receiving groove, with fitting grooves into which projecting rods formed in a flanged portion of a bobbin are press-fitted, so that the yoke and the bobbin can both be fixed in an adjacent relation.

(3) A third aspect of the present invention is characterized by the base having a projecting rib formed with the yoke receiving groove, the cutout groove, and the fitting grooves, so that the yoke and the bobbin are held with the rib projecting from the base reinforced.

(4) A fourth aspect of the present invention is characterized by the iron core being formed with a small diameter portion for being fitted in a U-shaped split groove of the yoke, and a head portion for being fitted in a cutout groove of a base, so that the iron core can be assembled by press-fitting into the base, thereby simplifying assembling operations and making it possible to automatically assemble the electromagnetic relay using a machine.

It will be appreciated that the present invention is not limited to the exact construction that has been described above and illustrated in the accompanying drawings, and that various modifications and changes can be made without departing from the scope and spirit thereof. It is intended that the scope of the invention only be limited by the appended claims.

What is claimed is:

1. An electromagnetic relay comprising an iron core (2) fixed to a yoke (3) and one end of said yoke (3) fixed by press-fitting to a base (4);

wherein said base (4) is formed with a yoke-receiving groove (4*b*) into which tongue pieces (3*e*, 3*e*) at one end of said yoke (3) are press-fitted and a cutout groove (4*c*) into which a head portion (2*c*) of said iron core 2 is received;

wherein said yoke (3) is formed with a seal projection (3*f*) disposed by insertion in an opening end of a cutout groove (4*c*) of said base (4);

wherein said base (4) is formed, adjacent to said yoke-receiving groove (4*b*), with fitting grooves (4*a*, 4*a*) into which projecting rods (1*b*, 1*b*) formed in a flanged portion (1*a*) of a bobbin (1) are press-fitted; and wherein said iron core (2) is formed with a small diameter portion (2*a*) for being fitted into a U-shaped split groove (3*a*) of said yoke (3), and a head portion (2*c*) for being fitted into a cutout groove (4*c*) of the base (4).

2. An electromagnetic relay according to claim 1, wherein said base (4) has a projecting rib (4*f*) formed with said yoke-receiving groove (4*b*), said cutout groove (4*c*), and said fitting grooves (4*a*, 4*a*).

3. An electromagnetic relay comprising an iron core (2) fixed to a yoke (3) and one end of said yoke (3) fixed by press-fitting to a base (4);

wherein said base (4) is formed with a yoke-receiving groove (4*b*) into which tongue pieces (3*e*, 3*e*) at one end of said yoke (3) are press-fitted and a cutout groove (4*c*) into which a head portion (2*c*) of said iron core 2 is received;

wherein said yoke (3) is formed with a seal projection (3*f*) disposed by insertion in an opening end of a cutout groove (4*c*) of said base (4); and wherein said iron core (2) is formed with a small diameter portion (2*a*) for being fitted into a U-shaped split groove (3*a*) of said yoke (3), and a head portion 2*c*) for being fitted into a cutout groove (4*c*) of the base (4).

4. An electromagnetic relay comprising:

a base having a fitting groove and a cutout groove;

a yoke having a U-shaped split groove defined by a pair of tongue pieces; and an iron core having a head portion at one end and a small diameter portion adjacent said head portion, said small diameter portion being press-fitted into said split groove of said yoke;

wherein said tongue pieces of said yoke are press-fitted into said fitting groove of said base, said head portion of said iron core is received within said cutout groove of said base, and said yoke has a seal projection that covers an opening of said cutout groove when the yoke is press-fitted to the base, whereby a void for confining metal chips produced during assembly is defined by said cutout groove of the base, said head portion of the iron core, said tongue pieces of the yoke, and said seal projection of the yoke.

5. An electromagnetic relay according to claim 4, wherein said seal projection is adjacent a deep end of said split groove.

6. An electromagnetic relay according to claim 5, wherein said tongue pieces are formed with slant surfaces on opposite sides of said split groove to facilitate insertion of said iron core into said split groove, said slant surfaces being located on the same side of the yoke as the seal projection.

7. An electromagnetic relay according to claim 4, wherein said yoke is generally L-shaped, and said split groove and said seal projection are located on a single leg of said L-shape.

* * * * *